United States Patent [19]

Ruvolo et al.

[11] 4,346,127

[45] Aug. 24, 1982

[54] PROCESS FOR PREPARING ABSORBING MOP MATERIAL OF NON-WOVEN FIBRES AND POLYMERIC BINDER

[75] Inventors: Antonio Ruvolo, Olgiate Olona; Vincenzo Massa, Milan, both of Italy

[73] Assignee: Montedison S.p.A., Italy

[21] Appl. No.: 106,049

[22] Filed: Dec. 21, 1979

Related U.S. Application Data

[63] Continuation of Ser. No. 912,834, Jun. 5, 1978, abandoned.

[30] Foreign Application Priority Data

Jun. 6, 1977 [IT] Italy ..... 24388 A/77

[51] Int. Cl.[3] ..... B05D 5/00

[52] U.S. Cl. ..... 427/244; 427/373; 427/381; 428/290

[58] Field of Search ..... 427/243, 244, 373, 381; 264/45.3, 53; 428/290, 317, 314, 306.6, 311.7, 316.6, 317.9; 521/68, 69, 72

[56] References Cited

U.S. PATENT DOCUMENTS

| | | | |
|---|---|---|---|
| 2,972,554 | 2/1961 | Muskat et al. | 427/373 X |
| 3,050,427 | 8/1962 | Slayter et al. | 264/45.3 X |
| 3,743,612 | 7/1973 | Vial | 521/69 |
| 3,940,535 | 2/1976 | Gaeth et al. | 428/260 |
| 3,985,929 | 10/1976 | Bonin et al. | 428/290 |
| 4,038,350 | 7/1977 | Jacques | 264/45.3 X |
| 4,082,878 | 4/1978 | Boe et al. | 428/290 X |

*Primary Examiner*—Evan K. Lawrence

*Attorney, Agent, or Firm*—Stevens, Davis, Miller & Mosher

[57] ABSTRACT

A process is disclosed for preparing an absorbing mop material comprising a substratum of non-woven fibres and a flexible, porous, polymeric binder. The process comprises preparing a non-woven web of textile fibres, consisting essentially of a cellulosic material, preparing an aqueous dispersion containing a thermocoagulable polymer and a coagulating agent, adding to the aqueous dispersion a liquid expanding agent having a boiling point of 30° C. to 80° C., impregnating the web with the aqueous dispersion to which the expanding agent has been added, subjecting the impregnated web to a heat treatment at 40° C. to 90° C., washing the web with water, and subjecting the web to a further heat treatment at a temperature equal to or greater than 100° C.

9 Claims, No Drawings

PROCESS FOR PREPARING ABSORBING MOP MATERIAL OF NON-WOVEN FIBRES AND POLYMERIC BINDER

This is a continuation of application Ser. No. 912,834 filed June 5, 1978, abandoned.

The present invention relates to a process for preparing high-porosity manufactured articles comprising a substratum of non-woven fibres and a flexible polymeric binder, which are useful as absorbing mops for cleaning window panes, floors, etc.

Manufactured articles of this type, prepared by impregnating non-woven fabrics with mechanically foamed acrylic, butadiene-nitrilic, or polyurethane emulsions, are already known. The conventional process involves the use of specific machines and high operating costs for the production of mechanical foams.

According to the process of this invention, a textile fibre web, which optionally may be subjected to cohesion mechanical treatments, such as, e.g., the needle treatment, and having a weight from about 50 to about 300 g/m$^2$, is impregnated with an aqueous dispersion containing, as essential components, a thermo-coagulable polymer fit for use as a binder for textile fibres, and a volatile liquid suited for use as an expanding agent during a coagulating heat treatment following the impregnation. In the heat treatment, due to the evaporation of the expanding agent, the polymeric binder that is fixed to the fibrous substratum assumes a porous structure, thereby imparting good absorbing properties to the final manufactured article.

The fibrous substratum consists essentially of textile fibres of a cellulosic material, either natural or synthetic, and can optionally include a blend with the cellulosic material of synthetic fibres of a different chemical nature. Cotton fibres, viscose fibres, and blends thereof with polyamide fibres, polyester fibres etc. are particularly suited to the purposes of this invention. The presence of fibres of a cellulose material is necessary to impart a sufficient water absorbing capacity to the manufactured article, while the synthetic fibres of a different chemical nature are useful to improve the mechanical properties of the manufactured article.

Polymers suitable for use in the aqueous dispersion are those normally employed as binders for textile fibres and capable of being subjected to a thermo-coagulating treatment. Acrylic polymers, such as polymers and copolymers of acrylonitrile, acrylic esters, acrylic acid, and butadiene/acrylonitrile copolymers are particularly useful. The concentration of the polymer in the aqueous dispersion generally comprises between about 15% and about 60%, by weight of the dispersion.

The expanding agent, consisting of one or more organic liquid compounds, has a boiling point ranging from 30° to 80° C., said boiling point being lower than the temperature employed in the thermo-coagulating treatment. The expanding agent must be either insoluble or only partially soluble in water, and must be compatible with the polymeric binder. In practice it must neither possess dissolving properties, nor exert a sensible swelling action, on the polymer.

The following compounds, and mixtures thereof, are particularly suitable: trichlorofluoromethane, 1,1,2-trichlorotrifluoroethane, n-hexane, trichloroethylene, methylene chloride, n-pentane. The amount of expanding agent used can be from about 20% to about 120%, by weight, with respect to the weight of polymer used as a binder (calculated on dry basis). The mixture of the above-said components, i.e., the binding polymer and the expanding agent, in the aqueous vehicle, includes, furthermore, suitable coagulating agents capable of promoting the thermo-coagulation of the polymer.

It is possible to use products which are already known for the coagulation of polymeric latexes, such as, for example: Cartafix 1, produced by Sandoz (quaternary polyamines of polyhydroxyalkylenes); coagulating agent W.S., produced by Bayer (polyfunctional organopolysiloxanes); and ROLQUAT CDM-BC, produced by ROL (cationic surfactants of the type of quaternary ammonium salts).

The aqueous dispersion may also contain the following ingredients as auxiliary agents:

Aqueous dispersion stabilizers, including non-ionic surfactants, such as polycondensates of ethylene oxide with alkylphenols, or protecting colloids (polyvinyl alcohol, etc.) are particularly suited. The stabilizer amount and the coagulating agent amount are usually adjusted in order that the coagulating temperature of the latex may range from 40° to 70° C.

Water-miscible resins, of the thermosetting type, capable of acting as cross-linking agents and of imparting higher stiffness and mechanical strength to the manufactured article. Some useful examples of these resins are: methylolated melamine/formaldehyde resins, such as Permafresh MEL, manufactured by ROL, or analogous products (Aerotex M3, etc.); and urea/formaldehyde resins, such as Xilocolla 12570, produced by Montedison. Of course, these resins require the presence of acid catalysts for their crosslinking.

Dyestuffs, pigments, and different solid fillers.

The aqueous dispersion to be used for the impregnation has a composition generally comprised as follows:

| | | |
|---|---|---|
| Polymeric binder | 15–60 | parts by wt. |
| Stabilizing agent (non-ionic surfactant) | 0–2 | parts by wt. |
| Dyestuff, pigment, solid fillers | 0–5 | parts by wt. |
| Coagulating agent | 0.2–8 | parts by wt. |
| Thermosetting (cross-linking) resin | 0–10 | parts by wt. |
| Acid catalyst for thermosetting resin | 0–2 | parts by wt. |
| Water: in an amount sufficient to make up to | 100 | parts by wt. |

The expanding agent, in an amount from about 20% to about 120%, by weight, with respect to the weight of the polymeric binder (calculated on dry basis), is added to the aqueous dispersion. The mixture is then homogenized by stirring before being used.

The impregnation of the fibrous substratum with the aqueous dispersion of the polymeric binder may be carried out according to any method, for instance, by simple immersion in a bath.

The amount of water dispersion absorbed by the fibrous substratum can be checked and regulated by causing the substratum to pass between pairs of pressing cylinders: the amount of absorbed impregnating mixture is such, that the content of solid components from the dispersion in the finished product is between 100% and 250%, by weight, with respect to the weight of the fibrous substratum, and preferably comprises between 120% and 180%.

The process for manufacturing the article according to the present invention includes, successively to the impregnation of the fibrous substratum with the above-said aqueous dispersion, the following steps:

(a) a heat-treatment to bring about the thermo-coagulation of the polymer latex and the evaporation of the expanding agent, thus obtaining a porous structure of the polymeric binder;

(b) a washing of the manufactured article in water;

(c) a further heat-treatment for the drying and partial cross-linking of the polymeric material.

The first heat-treatment (a), is conducted at a temperature ranging from 40° C. to 90° C., and preferably from 70° C. to 80° C. It can be carried out using conventional apparatus, for example, in an air circulating furnace or in an infrared ray furnace.

Washing (b) is effected preferably with lukewarm or warm water.

In treatment (c), drying is effected at temperatures between 100° C. and 120° C., while cross-linking is carried out at even higher temperatures, around 140° C. Of course both operations may occur simultaneously or at least in a one-step heat-treatment.

The manufactured articles obtained from the process according to this invention have a weight of the order of 100–750 g/m$^2$. Characteristics indicative of the good applicative properties are apparent from the following examples. The examples are given merely to illustrate the present invention, without being, however, a limitation thereof.

EXAMPLE 1

A viscose-fibre web, obtained from crossed cards, and weighing 120 g/m$^2$, was needle-treated at 150 prickings/cm$^2$. It was then impregnated by immersion into a bath containing:

| | |
|---|---|
| Crilat DR 1401 of Montedison (1) | 400 parts by wt. |
| Rioklen NF 40 of ROL (2) | 5 parts by wt. |
| Water-dispersed pigment "Velesta" of ACNA (3) | 2 parts by wt. |
| Coagulating agent W.S. of Bayer diluted to 50% with water (4) | 5 parts by wt. |
| 1,1,2-trichloro-trifluoroethane | 60 parts by wt. |

(1) Thermo-coagulable acrylic polymers in aqueous dispersion at 45% by weight.
(2) Nonyl-phenol condensed with 40 moles of ethylene oxide at 30% by weight in water.
(3) Mixture of: 100 parts by weight of Yellow Velesta 2GR + 1 part by weight of Brown Velesta BR + 5 parts by weight of Scarlet Velesta FGR.
(4) 47.6% aqueous solution of polyfunctional polysiloxane, pH - 8, density = 1.03, cloud point of the aqueous solution at 15% = 31° C.

The bath was previously homogenized by stirring for 5 minutes by means of a Lenart stirrer at 350 r.p.m. The aqueous dispersion, at a pH=3.4 prior to addition of the expanding agent, had a coagulation point=57° C. to 59° C. The impregnated web was passed between 2 rolls separated at a distance of 0.5 mm, and exerting a pressure of the order of 8 kg/cm$^2$, in order to adjust the amount of dispersion absorbed by the substratum so that it might correspond to about 220 g/m$^2$ of dry matter (polymer plus auxiliary materials). The thermo-coagulation heat-treatment, which is useful also to evaporate the expanding agent, was conducted for 7 minutes in a BENZ furnace, of the type with hot air circulation, at 80° C.

The successive washing was effected in water at 50° C. to 60° C.

The final, drying, heat-treatment was carried out for 7 minutes at 120° C. in a hot air circulation furnace.

The characteristics of the manufactured article so obtained are reported in Table I, on page 15.

EXAMPLE 2

A fibre web prepared as in Example 1 was impregnated by immersion into a bath containing:

| | |
|---|---|
| Elaprim D 342 of Montedison (a butadiene/acrylonitrile copolymer in aqueous dispersion at 50%) | 400 parts by wt. |
| Rioklen NF 80 of ROL (nonyl-phenol condensed with 80 moles of ethylene oxide at 30% in water) | 10 parts by wt. |
| Water-dispersed pigment Velesta of ACNA (*) | 1.5 parts by wt. |
| Cartafix U coagulating agent of Sandoz at 14% by weight in water | 140 parts by wt. |
| 1,1,2-trichloro-trifluoroethane | 60 parts by wt. |

(*)Mixture of 100 parts by wt. of Yellow Velesta 2GR + 1 part by wt. of Brown Velesta BR + 5 parts by wt. of Scarlet Velesta FGR.

The bath was homogenized by stirring as specified in Example 1 and brought to a pH=4.9 by addition of maleic acid (the mixture as such had a pH=8.9). The aqueous dispersion at a pH=4.9 exhibited, in the absence of the expanding agent, a coagulation point at 46° C. to 48° C.

The successive operations were conducted according to the same operative procedures and under the same conditions as described in Example 1.

The characteristics of the resulting article are reported in Table I, on page 15.

EXAMPLE 3

In this example a fibre web was impregnated as in Example 1, using an impregnating bath consisting of:

| | |
|---|---|
| Crilat DR 1401 | 200 parts by wt. |
| Elaprim D 342 | 200 parts by wt. |
| Rioklen NF 40 (at 30% in water) | 5 parts by wt. |
| Pigment Velesta (see Example 1) | 1.5 parts by wt. |
| Cartafix U at 50% in water | 40 parts by wt. |
| n-hexane | 60 parts by wt. |

The bath was homogenized by means of stirring as in Example 1, and was brought to a pH=4.9 by maleic acid. The aqueous dispersion having a pH=4.9 exhibited, in the absence of the expanding agent, a coagulation point at 40° C. to 42° C.

The successive operations were conducted as describedin Example 1.

The characteristics of the manufactured article obtained are reported in Table I, on page 15.

EXAMPLE 4

In this example a fibre web was impregnated as in Example 1, using an impregnating bath consisting of:

| | |
|---|---|
| Crilat DR 1401 | 200 parts by wt. |
| Elaprim D 342 | 200 parts by wt. |
| Rioklen NF 40 (at 30% in water) | 5 parts by wt. |
| Pigment Velesta (see Example 1) | 1.5 parts by wt. |
| Permafresh MEL of ROL (methyl-olated melamine/formaldehyde resin at 83% of active substance) | 5 parts by wt. |
| Cartafix U (at 50% in water) | 40 parts by wt. |
| Mixture of 1,1,2-trichloro-trifluoroethane + trichloro-fluoromethane + trichloroethylene | 60 parts by wt. |

-continued

| | |
|---|---|
| in a 60/10/30 ratio by weight, having a boiling point at 43° C. | |

The bath was homogenized by stirring, and brought to a pH=4.9 by means of maleic acid. The aqueous dispersion at a pH=4.9, in the absence of the expanding agent exhibited a coagulation point at 43° C. to 45° C.

The successive operations were effected as described in Example 1.

The characteristics of the resulting manufactured article are reported in Table I, on page 15.

EXAMPLE 5

A fibre web was impregnated according to Example 1, using an impregnation bath consisting of:

| | |
|---|---|
| Crilat DR 1401 | 200 parts by wt. |
| Elaprim D 342 | 200 parts by wt. |
| Rioklen NP 40 (at 30% in water) | 5 parts by wt. |
| Pigment Velesta (see Example 1) | 1.5 parts by wt. |
| Cartafix U (at 50% in water) | 40 parts by wt. |
| n-pentane | 60 parts by wt. |

The bath was homogenized by stirring, and brought to a pH=4.9 by means of maleic acid. The aqueous dispersion, at a pH=4.9, in the absence of the expanding agent exhibited a coagulation point at 55° C. to 57° C.

The successive operations were conducted as described in Example 1.

The characteristics of the manufactured article so obtained are reported in Table I at page 15.

EXAMPLE 6

A fibre web was impregnated as in Example 1, using an impregnation bath consisting of:

| | |
|---|---|
| Crilat DR 1401 | 400 parts by wt. |
| Rioklen NF 40 (at 30% in water) | 5 parts by wt. |
| Pigment Velesta (see Example 1) | 1.5 parts by wt. |
| Coagulating agent W.S. diluted (at 50% in water) | 5 parts by wt. |
| Mixture of 1,1,2-trichloro-trifluoroethane + methylene chloride in a 50/50 molar ratio (boiling point at 37° C.) | 60 parts by wt. |

The bath was homogenized by stirring as described in Example 1.

The aqueous dispersion, having a pH=3.4, exhibited, in the absence of expanding agent, a coagulation point of 56° C. to 58° C.

The successive operations were effected as described in Example 1.

The characteristics of the manufactured article obtained are reported in Table I, on page 15.

Table I also shows, by way of comparison, data relating to a known product that has already found favorable acceptance in the Italian market.

To determine the characteristics of the manufactured articles prepared according to this invention, the following methods were followed:

1. Determination of the Capillarity a. Procedure

Rectangular test pieces having dimensions 2×15 cm were cut.

Two notches, in proximity of 5 cm and 10 cm, were made.

The test pieces were dipped for 5 cm into deionized water at 20° C., avoiding contact with the container lips.

The time required to wet the test pieces up to a height of 5 cm above the liquid level was taken.

The determination was made on 5 test pieces.

b. Expression of the Results

The capillarity value is expressed by indicating the average time, in seconds, required to wet the test pieces up to a height of 5 cm.

2. Determination of the Water Absorption a. Procedure

Square test pieces measuring 5×5 cm were cut. After a 60-minute conditioning in a drier containing calcium chloride, the test pieces were weighed.

They were dipped into deionized water at 20° C. and kept therein for 10 minutes.

They were taken out and allowed to drop on a wire net for 2 minutes.

They were weighed.

The determination was made on 5 test pieces.

b. Expression of the Results

The water absorption is expressed as the increase by percent in the weight of the test pieces.

3. Resistance to Normal Washings a. Equipment

Launder Ometer washing machine of Atlas Electric Devices Co., Chicago (U.S.A.)

b. Procedure

Square test pieces measuring 5×5 cm were cut. After a 60-minute conditioning in a drier containing calcium chloride they were weighed. The test pieces were introduced into proper steel bottles containing an aqueous solution with 5 g/l of a cleansing agent (domestic type) and 50 stainless steel balls of 6 mm diameter. A 5-hour washing cycle at a temperature of 90° C. was carried out.

The test pieces were repeatedly rinsed with flowing water, dried at 80° C., conditioned for 60 minutes in a drier and weighed. The determination was made on 5 test pieces.

c. Expression of the Results

The resistance to normal washing is expressed as an evaluation of the appearance of the test piece and the alterations, if any, resulting from the washing, with values ranging from 1 (bad) to 10 (very good) and for a comparison with proper standard scales, the percent, by weight, loss is also indicated.

4. Flowing Test a. Procedure

By means of a syringe pipette, 1 cc of water was placed onto a glass plate measuring 20×30 cm.

The mop being tested, measuring 15×15 cm, was passed thereon, observing streakings, halos, and opacities, if any.

The test was conducted on at least 5 points, always using a dry mop.

b. Expression of the Results

The flowing value is expressed on the basis of the formation of streaks, halos, opacities etc., attributing values ranging from 1 (bad) to 10 (very good).

5. Determination of Pilling a. Equipment

Abrasion tester of Branca, Milan (Italy)

b. Procedure

Square test pieces measuring 20×20 cm were cut They were mounted onto a suitable test piece stand and, using a nylon brush and a pressure of 50 g/cm$^2$, the brush was made to rotate until rising of the fibres was observed. The determination was made on at least 3 test pieces.

c. Expression of the Results

The resistance to pilling is expressed as an evaluation of the fibre consistency, indicating whether the pills were big, small, or very small, or, as an alternative, attributing values ranging from 1 (bad) to 5 (very good) to the purpose of a comparison with proper standard scales, indicating also the number of cycles necessary to cause alternations.

For the tensile strength, method UNI 5116 was adopted.

TABLE I

| Determination | Measurement Unit | Example 1 | Example 2 | Example 3 | Example 4 | Example 5 | Example 6 | Known Product |
|---|---|---|---|---|---|---|---|---|
| Weight of the article | g/m$^2$ | 344 | 350 | 320 | 318 | 342 | 340 | 260 |
| Capillarity | seconds | 30 | 30 | 180 | 500 | 70 | 40 | 90 |
| $H_2O$ absorption | % | 390 | 290 | 350 | 270 | 400 | 300 | 390 |
| Resistance to normal | appearance | 10 | 9 | 10 | 10 | 10 | 10 | 10 |
| washings | %, by wt., loss | 1.6 | 8.0 | 4.6 | 3.8 | 4.6 | 1.5 | 8.6 |
| Flowing | (1) | 10 | 10 | 9 | 8 | 10 | 10 | 10 |
| Pilling | cycles (1) | 100/5 | 100/2 | 100/3 | 100/5 | 10/3 | 100/5 | 10/3 |
| Hand characteristics | — | excell. | rather good | rather good/ good | rather good | excell. | excell. | excell. |
| Tensile strength | kg/mm$^2$ | 51–53 | — | — | — | — | — | 41–41 |
| Elongation | % | 55–75 | — | — | — | — | — | 56–59 |

(1) See the description of the method.

What we claim is:

1. A process for preparing an absorbing mop material having a weight ranging from 100 to 750 g/m$^2$ comprising a substratum of non-woven fibers and a flexible, porous polymeric binder, said process comprising:

preparing a non-woven web of unbonded textile fibers consisting of essentially a cellulosic material, said web having a weight of from about 50 to about 300 g/m$^2$;

preparing a polymeric aqueous dispersion containing (a) from about 15 to about 60 parts, by weight, per 100 parts by weight of the dispersion, of a thermo-coaguable polymer of the type generally used as a binder for textile fibers, and (b) from about 0.2 to about 8 parts, by weight, per 100 parts by weight of the dispersion, of a coagulating agent suitable for the thermo-coagulation of the polymeric binder at a temperature between 40° and 90° C;

adding to the aqueous dispersion an expanding agent consisting of a liquid having a boiling point of 30° C. to 80° C. that exerts no dissolving or swelling action on the polymeric binder, in an amount from about 20% to about 120%, by weight, with respect to the weight of the polymeric binder;

impregnating said web with the polymeric aqueous dispersion to which the expanding agent has been added;

subjecting the impregnated web to a heat treatment at 40° C. to 90° C. in order to bring about the coagulation of the polymeric aqueous dispersion and the evaporation of the expanding agent;

washing the web with water; and drying said web and partially crosslinking the polymeric binder of said web by subjecting the web to a further heat treatment, at a temperature equal to or higher than 100° C.

2. A process according to claim 1 wherein the thermo-coagulable polymer is selected from the group consisting of polymers and copolymers of acrylic esters, acrylic acid, acrylonitrile, and butadiene.

3. A process according to claim 1 wherein the expanding agent is selected from the group consisting of trichlorofluoromethane, 1,1,2-trichlorotrifluoroethane, n-hexane, trichloroethylene, n-pentane, methylene chloride, or mixtures thereof.

4. A process according to claim 1 wherein the fibrous substratum is impregnated with an amount of aqueous dispersion such that the amount of solid components from the dispersion in the final product is between 100% and 250%, by weight with respect to the weight of said substratum.

5. A process according to claim 1 wherein the heat treatment for the coagulation and for the evaporation of the expanding agent is carried out at 70° C. to 80° C.

6. A process according to claim 1 wherein the aqueous dispersion contains a stabilizer, in an amount up to about 2 parts, by weight, per 100 parts by weight of the dispersion.

7. A process according to claim 1 wherein the aqueous dispersion contains dyes, pigments, and solid fillers, in an amount up to about 5 parts, by weight, per 100 parts by weight of the dispersion.

8. A process according to claim 1 wherein the aqueous dispersion contains as an auxiliary agent a water-miscible resin of the thermosetting type in an amount up to about 10 parts, by weight, per 100 parts by weight of the dispersion, said resin being capable of acting as a cross-linking agent and of imparting higher stiffness and mechanical strength to said mop material.

9. A process according to claim 8 wherein the aqueous dispersion contains an acid catalyst for the resin, in an amount up to about 2 parts, by weight, per 100 parts by weight of the dispersion.

* * * * *